US006301831B1

(12) United States Patent
Cundy et al.

(10) Patent No.: US 6,301,831 B1
(45) Date of Patent: Oct. 16, 2001

(54) CHILD SAFETY BARRIER FOR USE IN A DRIVEWAY

(76) Inventors: John P. Cundy, 49409 Shenandoah Dr.; James E. Malczewski, 21210 Raintree, both of Macomb, MI (US) 48044

( * ) Notice: Subject to any disclaimer, the term of this patent is extended or adjusted under 35 U.S.C. 154(b) by 0 days.

(21) Appl. No.: 09/627,679

(22) Filed: Jul. 28, 2000

Related U.S. Application Data

(60) Provisional application No. 60/147,167, filed on Aug. 4, 1999.

(51) Int. Cl.[7] ..... E01F 13/00
(52) U.S. Cl. ..... 49/49; 404/10; 404/15
(58) Field of Search ..... 49/49, 477.1; 404/9, 404/10, 15, 8, 6; 256/1

(56) References Cited

U.S. PATENT DOCUMENTS

| | | | | |
|---|---|---|---|---|
| 1,658,097 | | 2/1928 | Pierce . | |
| 2,174,884 | | 10/1939 | Kachel | 273/30 |
| 4,142,814 | * | 3/1979 | Sanchez | 404/7 |
| 4,521,129 | * | 6/1985 | Krech et al. | 404/10 |
| 4,971,319 | | 11/1990 | Cutrone | 273/29 B |
| 5,186,438 | | 2/1993 | Cross et al. | 256/13.1 |
| 5,345,731 | | 9/1994 | Sykes | 52/102 |
| 5,407,178 | | 4/1995 | Long | 256/45 |
| 5,527,127 | * | 6/1996 | Junker | 404/6 |
| 5,836,714 | | 11/1998 | Christensen | 404/0.6 |
| 6,024,510 | * | 2/2000 | Kamienchick | 404/15 |
| 6,059,268 | | 5/2000 | Santelli, Jr. | 256/25 |

FOREIGN PATENT DOCUMENTS

| | | | | |
|---|---|---|---|---|
| 2293526 | * | 7/1976 | (FR) | 404/10 |

* cited by examiner

*Primary Examiner*—Jerry Redman
(74) *Attorney, Agent, or Firm*—Young & Basile, P.C.

(57) ABSTRACT

A safety barrier positionable across a path for deterring rolling objects from passing beyond the barrier includes an elongate hollow member having open lateral ends. The elongate hollow member includes a base for positioning on a surface and an upwardly extending wall having an arcuate concave surface for hindering rolling objects from passing beyond the barrier.

15 Claims, 4 Drawing Sheets

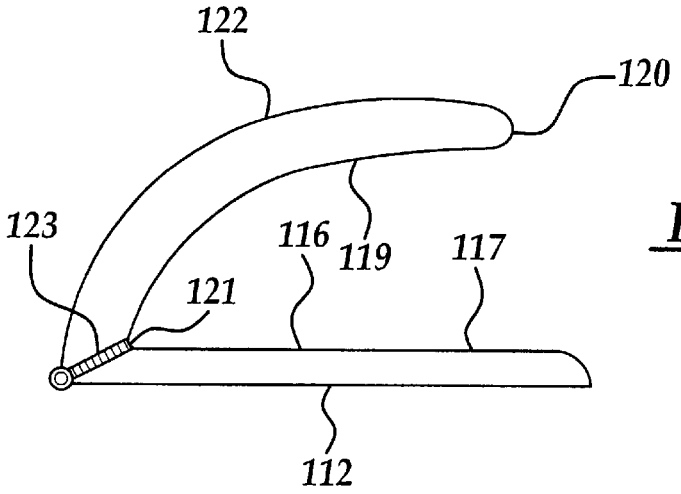
Figure 5a
Figure 5b
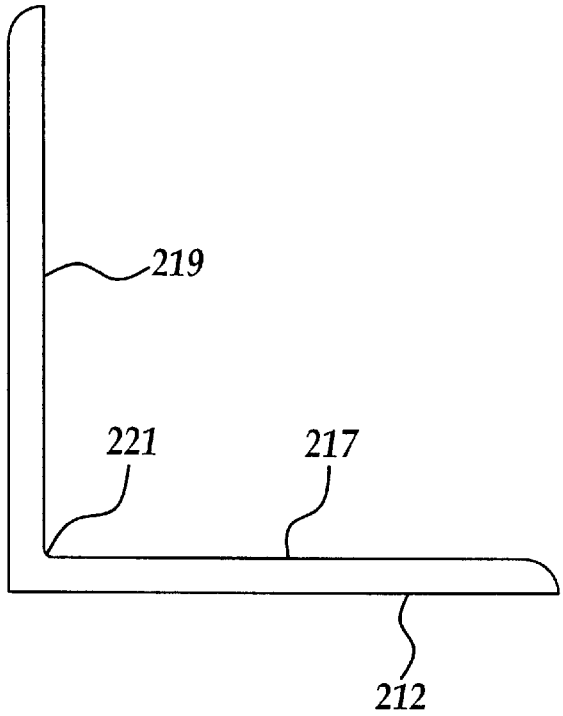
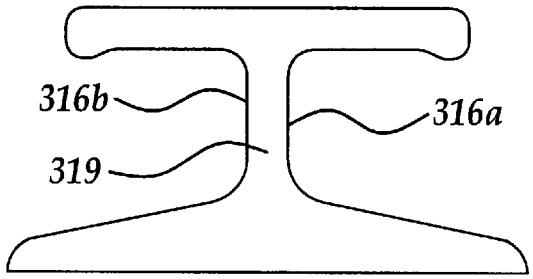
Figure 5c

CHILD SAFETY BARRIER FOR USE IN A DRIVEWAY

This application claims benefit Prov. No. 60/147,167 filed Aug. 4, 1999.

FIELD OF THE INVENTION

The invention relates to a child's safety barrier and especially a barrier for positioning near an end of the driveway or other inclined surface for preventing rolling objects such as balls from passing the barrier.

BACKGROUND OF THE INVENTION

Children's safety is a major concern of parents, caretakers, and other adults. Most adults know of an occurrence when a child has run after a ball rolling into the street where and has not looked out for possible oncoming traffic. Tragically, some children have been injured or killed by a vehicle when they ran into the street to retrieve the ball. Parents in the past have provided a makeshift barrier at the end of their driveway out of furniture, blocks of wood, and other articles to prevent their children's play toys from rolling into the street and thereby preventing the children from retrieving the play toys. These previous barriers used by parents to block rolling objects were generally cumbersome to move, unattractive and did not always stop the rolling object. In addition, the articles had to be removed from a driveway before a vehicle could proceed into the homeowner's yard.

SUMMARY OF THE INVENTION

It is the intent of the current invention to address the aforementioned concerns by providing a barrier for rolling objects and especially for children's balls and other rolling playthings that is lightweight to carry, transportable, durable, easily connectable to each other to adjust its length, as well as easy and inexpensive to manufacture. The safety barrier of the present invention is an elongated member having a base and a first and second wall extending upwardly from the base. The first and second walls meet at an upper point spaced above the base wherein at least one of the walls has a concave exterior surface.

In another aspect of the invention the concave exterior surface may include a first ramp extending from the base to an innermost point and a second ramp extending from the innermost point to the upper point.

In yet another aspect of the invention, the base may include means for allowing liquids to drain past the barrier.

In another aspect of the invention, there is a means of releasably securing one barrier to an adjacent barrier.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIGS. 5*a*–5*f* show other embodiments of the safety barrier.

DESCRIPTION OF THE PREFERRED EMBODIMENT

The present invention provides a bumper style safety barrier for placement near or at the end of a driveway 5 or other incline surfaces where children are likely to play. The safety barrier is provided and designed to deter run-away balls, tricycles, baby carriages and other rolling objects from passing the safety barrier and rolling into the street and into potential oncoming traffic.

The safety barrier 10 of the present invention includes an elongated structure for placement laterally across a driveway 5 to define a safe play area 11 for children. The safety barrier 10 is preferably configured such that a ball or other rolling device used by a child is deterred from jumping over and passing the safety barrier 10 and continuing into a dangerous area, such as a street 13.

Figure 3:
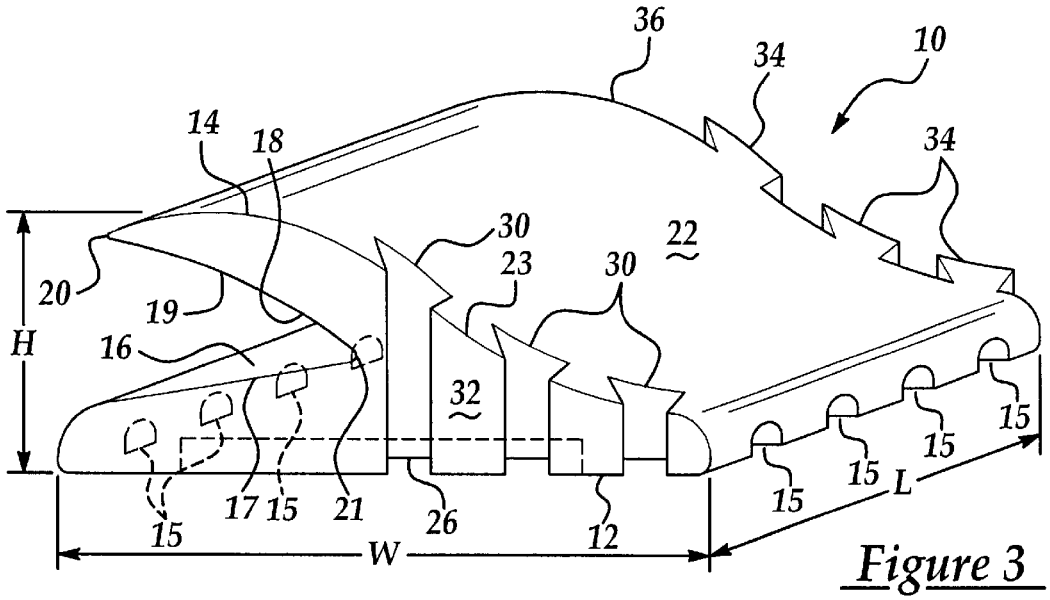
FIG. 3 is a perspective view of another embodiment of the safety barrier illustrating a longitudinal end and a portion of the other elongated surface.

Looking at FIG. 3, the safety barrier 10 is structured to have a wider (W) base 12 than height (H). Currently, the height (H) from the base 12 to the highest point 14 of the safety barrier 10 is approximately four inches. The depth or width (W) of the base 12 is approximately eight inches. The length (L) of the safety barrier structure 10 can vary, but preferably has a length to extend over the driveway in four or five feet sections. The length (L) of the safety barrier 10 is kept to a reasonable length so that it can be easily transported and positioned manually to its designated location. The weight is also kept to less than ten pounds and preferably from four to six pounds.

Figure 1:
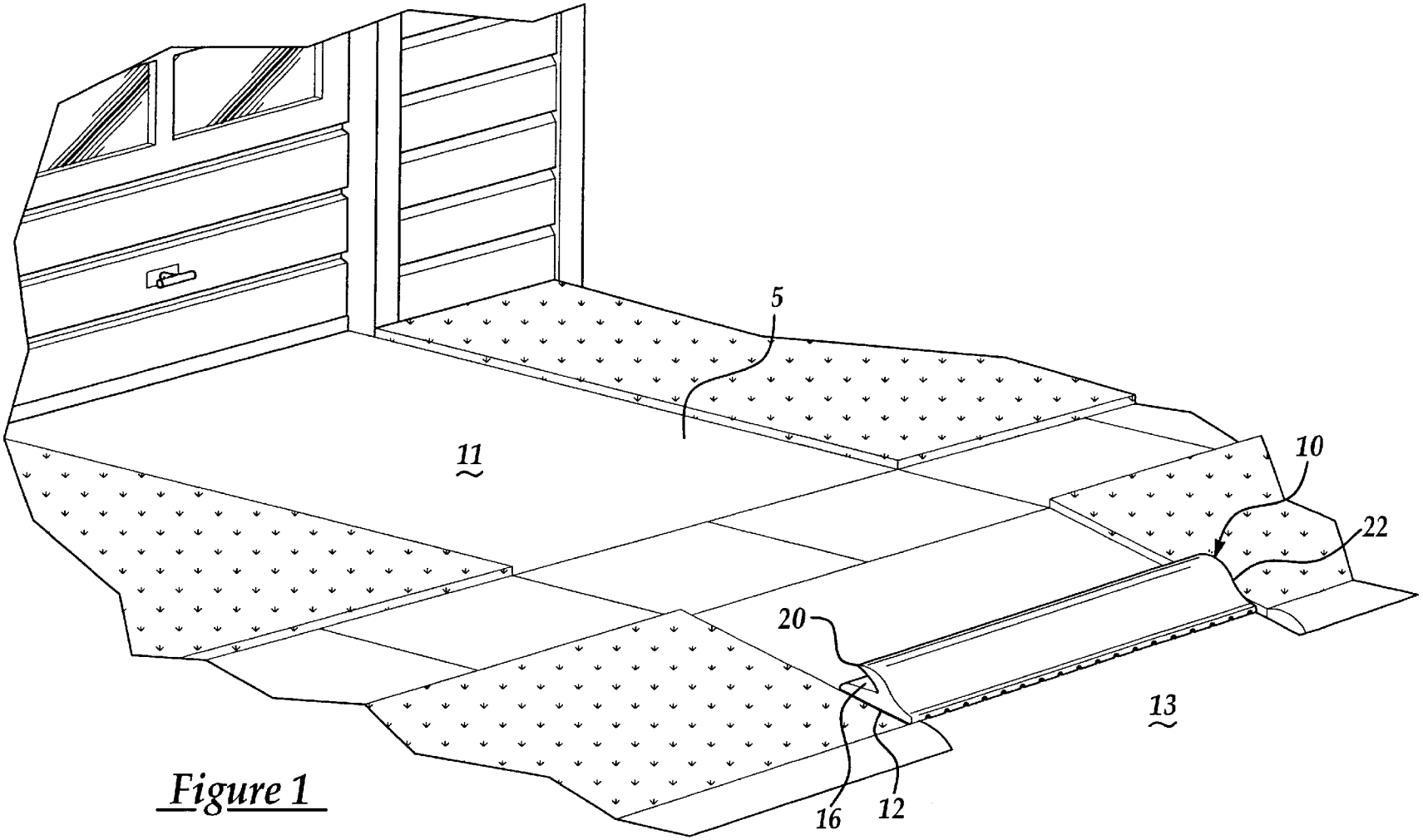
FIG. 1 is a perspective view of the safety barrier of the present invention positioned at an edge of a driveway.
Figure 2:
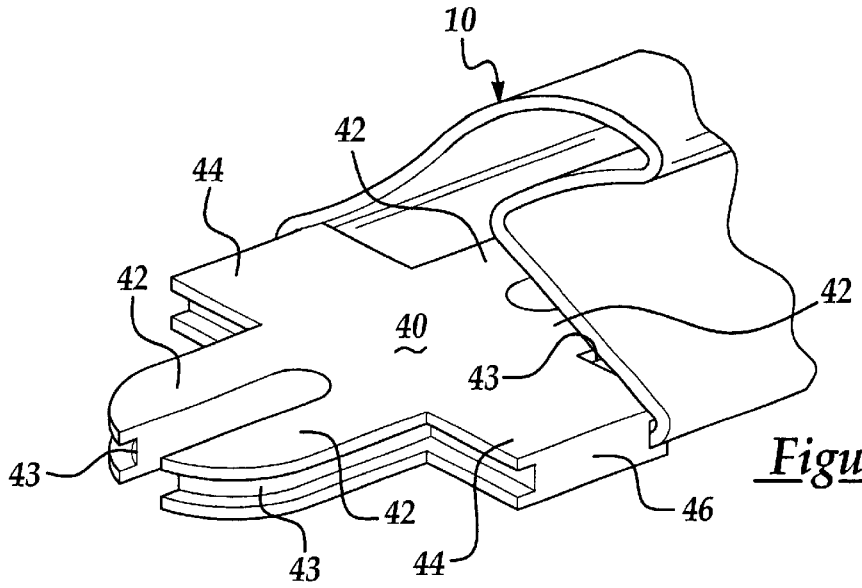
FIG. 2 shows a perspective view of one embodiment of the safety barrier with a connecting device installed at one end.

The preferred embodiment is shown in FIG. 2, wherein a connecting lock 40 is provided for placement between adjacent safety barriers 10. The connecting lock 40 has a general cross configuration with two of the opposing cross members forming a pair of spring loaded tines 42. The safety barrier 10 is modified to receive one of the pair of spring loaded tines 42 in each of the lateral ends. Each lateral end of the safety barrier 10 will have a keyhole 31 formed in the base 12. The keyhole 31 is shown in FIG. 5*e*. The pair of tines 42 are pushed together and inserted into keyhole 31. Upon release of the tines, the peripheral edge 33 of the keyhole 31 is held within the outer grooves 43 of the tines 42. The other two cross members 44 located approximately 90° relative to the tines 42 form a spacer between adjacent safety barriers. The spacing between adjacent safety barriers is the length of side 46 of cross members 44.

Figure 4:
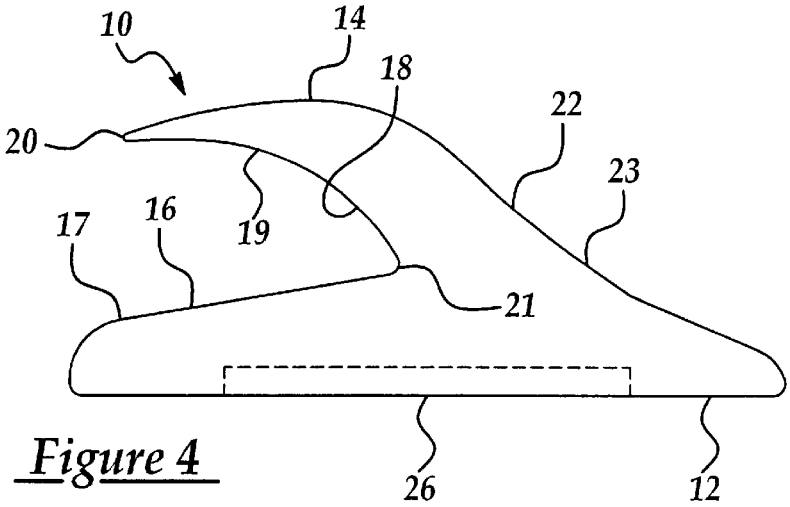
FIG. 4 is a side sectional view of the safety barrier in FIG. 3.

In another embodiment as shown in FIGS. 3 and 4, the base 12 is an essentially flat surface for positioning on a driveway 5 or other relatively smooth surface. The base 12 may include grooves or channels 15 extending the entire depth (W) of the base 12 to provide water drainage. The grooves 15 are spaced approximately every twelve inches along the length (L) of the safety barrier 10, and allows water that collects in the driveway 5 to drain to the street.

The highest point 14 of the safety barrier structure 10 is positioned slightly offset from the center of the base 12. The location of highest point 14 prevents the safety barrier 10 from being tipped over when rolling devices and toys roll into the safety barrier. The first elongated side 16 of the lateral length of the safety barrier 10 is concaved and preferred to have a triangular 18 recess along the entire length (L) for purposes discussed hereinafter. The top edge 20 of the triangular recess 18 should extend at least partially back toward the play area 11. The first elongated side 16 is configured so that one portions the safety barrier 10 to face the interior of the play area 11.

The barrier has a second elongated surface 22 that preferably meets the first side 16 at the top edge 20. Although both elongated surfaces 16, 22 may be configured to include the triangular recess 18 along each entire elongated surface, it is preferred and shown in the drawings that the second elongated surface 22 has a ramp formation to increase the structural stability of the overall safety barrier 10 and to easily allow a vehicle to ride over the safety barrier 10 without damage to the barrier 10.

As shown in FIGS. 1–4, 5*a*, 5*d*, 5*e* and 5*f* the cross-sectional configuration of the safety barrier 10 reflects a cresting wave. The width (W) of the base 12 of the safety barrier 10 has a dimension approximately twice the height (H) of the safety barrier. This helps to maintain the center of gravity near the base 12 to prevent the safety barrier 10 from easily tipping in one direction or another. As seen in FIG. 3, the first elongated surface 16 has a first ramp 17 extending from the flat base surface and continuing to an innermost point 21 of the triangular recess 18. The first elongated surface 16 then ramps 19 back to terminate at a top edge or forward point 20 of the crest. Each ramp 17, 19 of the first elongated surface 16 may be either linear or arcuate as shown in the figures. The triangular or concave recess 18 provides advantages over other configurations as will be discussed hereinafter. The safety barrier 10 further includes a second elongated surface 22 forming the rearward edge of the wave configuration. The second elongated surface 22 has a second ramp 23 with a shallow S-curve formation terminating at the forward point 20 of the crest.

The forward point or top edge 20 of the crest helps to resist rolling balls from jumping over the top edge or crest of the barrier. The forward point 20 of the crest will act as a stop for the ball. The second ramp 23 is provided with a shallow S-curve formation to provide more mass near the base 12 of the barrier and to follow the line of the arcuate or triangular recess of the first elongated surface 16 to provide more material at the crest. Therefore, the crest portion of the safety barrier provides a collapsible but durable ramp for a vehicle's wheels when encountering the barrier from the second elongated surface side 22. If a vehicle encounters the barrier from the first elongated surface side 16, the crest portion will again collapse under the weight of the vehicles wheels. Testing has indicated that the configuration with the triangular recess 19 shows repeatability to collapse and then spring back to its original shape.

When more than one barrier 10 is used to extend over a driveway, a keyway is provided to align and secure one barrier 10 adjacent to another barrier 10. One embodiment is shown in FIG. 2 wherein the keyway includes a keyhole 30 in one lateral end 32 and a complementary key 34 in the other lateral end 36. The keyhole 30 includes a groove or recess in the surface of lateral end 32. The key 34 includes a nodule having a complementary configuration in the other lateral end. When two or more barriers are placed adjacent to each other, the key 34 of one barrier fits into the keyhole 30 of the adjacent barrier to releasably secure the barriers together.

The child safety barrier 10 of the present invention is preferably made of a semi-rigid material that is lightweight, flexible, and weather impervious. The material must allow the crest portion of the barrier to collapse under predetermined weight, such as that of a vehicle's wheels, but then spring back to its original shape. The material must also be able to withstand a predetermined number of drive-overs by a vehicle. Such material that is being considered and tested is rubber, polyurethane and foam. The child safety barrier 10 may also be manufactured of a composite of the aforementioned materials. Although the safety barrier 10 is preferably hollow, it is advantageous to provide an insert 26 (shown in FIG. 4) of rubber along the base 12 when the barrier is made of a polyurethane. The rubber insert adds weight to the base 12 to prevent the barrier 10 from tipping over. The rubber insert further adds mass along the base to increase durability.

The safety barrier is configured so that the recessed surface is positioned toward the play area 11. If a ball rolls toward the barrier, the arcuate recess, and especially ramp 19 directs the ball back into the play area 11. If the ball is larger than the arcuate recess, the forward point 20 stops the ball from further rolling. The upper or outer arcuate surface 22 will temporarily collapse under the weight of a vehicle or other heavy objects, but will spring back to its previous shape when the weight is removed.

Although the preferred embodiments are shown in FIGS. 1–4, other configurations for the safety barrier 10 are envisioned. In FIG. 5*a*, the first elongated side 16 includes a first planar surface 117 that is generally horizontal and parallel to the base 112. The first planar surface 117 terminates at an innermost point 121. The first elongated surface 116 then has an arcuate ramp 119 to forward point 120. A hinge 123 is provided along the length (L) of the safety barrier 10 at the innermost point 121. If a vehicle drives over the safety barrier 10, the tire of the vehicle will travel over outer arcuate surface 122. The weight of the tires will move the outer arcuate surface 122 and arcuate ramp 119 toward the base 112 by pivoting at hinge 123. Once the weight is removed, the hinge biases the outer arcuate surface 122 away from base 112.

FIG. 5*b* shows another embodiment having a right angle configuration. The first planar surface 217 is also horizontal and parallel to base 212 and terminates at innermost point 221. Ramp 219 is vertical and at a right angle relative to first planar surface 217.

FIG. 5*c* show yet another embodiment which forms a pair of recesses 316*a*, 316*b* so that the safety barrier can be positioned having either recess 316*a*, 316*b* facing the play area. The center vertical portion 319 is flexible and can bend with the weight of tires and other heavy objects.

Figure 5D:
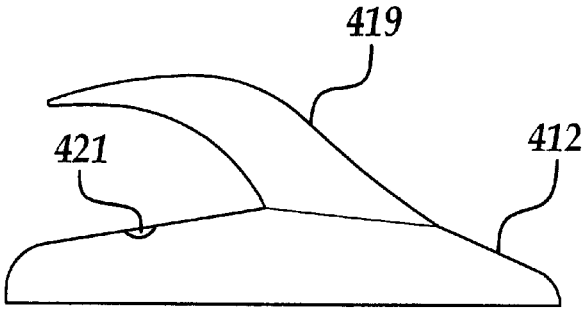
Figure 5E:
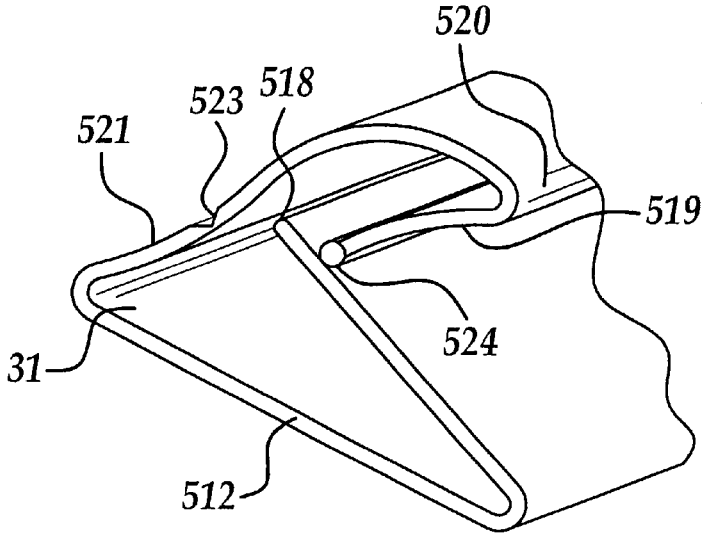

FIG. 5*d* shows an embodiment having a similar configuration as shown in FIGS. 1–4. In this embodiment, the lower portion forming the base 412 may be made of a solid rubber material or a plastic material having a hollow interior which can be filled with liquid, sand, or other material through an insert cap 421 to add weight to the base 412. The upper portion 419 is a hollow inflatable material that can be partially filled with air. When a tire travels over the upper portion 419, the air temporarily redistributes within the upper portion 419 until the weight is removed.

FIG. 5*e* shows an embodiment having a notch 523 along the outer, lower surface 521. The outer surface 521 terminates at crest 520. An undercrest 519 continues from crest 520 and terminates at roller 524 which extends the length of the barrier. The base 512 continues to a first elongate surface 516 having a first ramp 517 that terminates along an edge 518. The barrier in FIG. 5*e* is configured such that the roller 524 rests on the first elongate surface 516. If a predetermined weight, such a vehicle tire rolls over the barrier, the outer surface 521 will bend along notch 523 and roller 524 will roll down first ramp 517 as the outer surface 521 bends. Once the weight is removed, the barrier will return to the original configuration as shown in FIG. 5*e*. The notch may be replaced with any means of thinning of the material along the outer surface 516 to provide a bending location for the barrier.

Figure 5F:
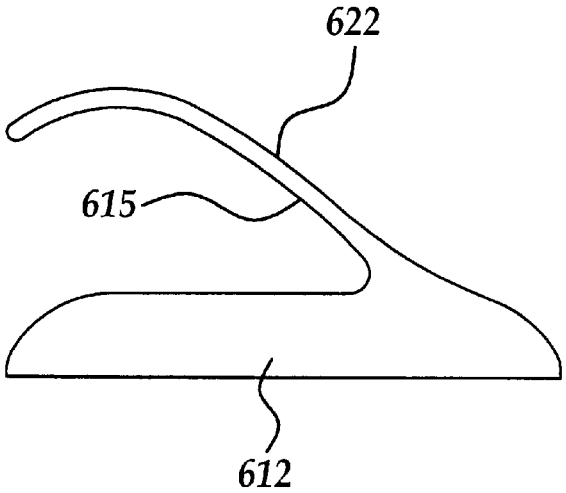

FIG. 5*f* shows another embodiment with a thick base 612 and a narrow upper portion formed by the outer ramp 622 and inner ramp 615.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. The safety barrier positionable across a path for deterring rolling objects form passing beyond the barrier, the safety barrier comprising:

an elongate member having a base and a first wall ramping angularly from the base and terminating at a first edge; said base having a second wall ramping angularly from the base above the first wall, said second wall terminating at a pointed portion, wherein said pointed portion has a third wall extending therefrom and terminating at a second edge, wherein said second edge is positioned above the first wall.

2. The safety barrier of claim 1, wherein said second edge has a roller attached thereon.

3. The safety barrier of claim 1, wherein the first wall has a means for bending said first wall under a predetermined weight.

4. A safety barrier positionable across a path for deterring rolling objects from passing beyond the barrier, the safety barrier comprising:

an elongate member having an original shape defined by a base for positioning across a path, said elongate member having a first wall extending from one longitudinal end of the base, said first wall ramping angularly from the base and terminating at a first edge, a second wall extending from the first edge and ramping angularly from the first edge, said second wall terminating at a second edge, a third wall extending from the other longitudinal end of the base, said third wall ramping from the base and terminating at the second edge, wherein the second edge is positioned above the first wall.

5. The safety barrier of claim 4, wherein the barrier is hollow.

6. The safety barrier of claim 4, wherein the elongate member has open lateral ends.

7. The safety barrier of claim 6, further comprising means for aligning and securing one barrier to an adjacent barrier wherein the means for aligning and securing the barrier includes a keyhole integrally formed in one lateral end of the barrier and a complementary key integrally formed in the other lateral end, wherein said keyhole and key are in alignment.

8. The safety barrier of claim 6, further comprising means for aligning and securing one barrier to an adjacent barrier wherein the means for aligning and securing the barrier includes a connecting device releasably connectable to a lateral end of a barrier, said connecting device having opposing spring-loaded tines insertible in the lateral ends of adjacent barriers.

9. The safety barrier of claim 4 wherein the barrier is made of a semi-rigid material that is lightweight, flexible and weather impervious.

10. The safety barrier of claim 4 further comprising means for weighting the base.

11. The safety barrier of claim 4, wherein one of the walls is hingedly connected to the base.

12. The safety barrier of claim 4, wherein a portion of the barrier is inflatable.

13. The safety barrier of claim 4 further comprising means for allowing the first, second, and third wall to collapse against the base under a predetermined weight and means for returning the elongated member to the original shape when the predetermined weight is removed.

14. The safety barrier of claim 4 further comprising a connecting device for connecting a pair of adjacent barriers, wherein the connecting device includes a pair of opposing spring-loaded tines and said elongated member has open lateral ends for receiving said tines.

15. The safety barrier of claim 4 wherein said base has an outer surface and grooves formed in the outer surface, wherein said grooves extend from one longitudinal edge to the other longitudinal edge of the base for draining liquids therethrough.

* * * * *